US005527852A

United States Patent [19]

Maruyama et al.

[11] Patent Number: 5,527,852

[45] Date of Patent: Jun. 18, 1996

[54] PAPER COATING AGENT

[75] Inventors: Hitoshi Maruyama, Kurashiki; Kazutoshi Terada; Tetsuya Katayama, both of Osaka, all of Japan

[73] Assignee: Kuraray Co., Ltd., Okayama, Japan

[21] Appl. No.: 465,891

[22] Filed: Jun. 6, 1995

Related U.S. Application Data

[63] Continuation of Ser. No. 279,852, Jul. 26, 1994, abandoned.

[30] Foreign Application Priority Data

Aug. 20, 1993 [JP] Japan ..... 5-206433

[51] Int. Cl.[6] ..... C08F 116/06

[52] U.S. Cl. ..... 524/503; 525/56; 525/62; 427/391; 428/402; 428/523

[58] Field of Search ..... 427/195, 391; 524/551, 503; 525/56, 61, 62; 428/523, 327, 336, 402, 537.5

[56] References Cited

U.S. PATENT DOCUMENTS

| | | | |
|---|---|---|---|
| 4,007,152 | 2/1977 | Kosaka et al. | 260/31.6 |
| 4,010,307 | 3/1977 | Canard et al. . | |
| 4,110,494 | 8/1978 | Schindler et al. | 427/385 R |
| 4,131,581 | 12/1978 | Coker | 260/29.1 R |
| 4,617,239 | 10/1986 | Maruyama et al. | 428/452 |
| 4,844,828 | 7/1989 | Aoki | 252/90 |
| 5,032,337 | 7/1991 | Nachtergaele et al. | 264/141 |
| 5,057,570 | 10/1991 | Miller et al. . | |
| 5,212,228 | 5/1993 | Sistrunk | 524/512 |
| 5,273,824 | 12/1993 | Hoshino et al. | 428/402.24 |
| 5,308,911 | 5/1994 | Takada et al. . | |
| 5,349,008 | 9/1994 | Takada et al. | 524/557 |

FOREIGN PATENT DOCUMENTS 1044311 11/1953 France .

*Primary Examiner*—Shrive Beck
*Assistant Examiner*—Brian K. Talbot
*Attorney, Agent, or Firm*—Oblon, Spivak, McClelland, Maier & Neustadt

[57] ABSTRACT

A coating agent comprising a particulate PVA having an average particle diameter of 0.01 to 1 μm has excellent applicability through blade coaters or roll coaters.

3 Claims, No Drawings

PAPER COATING AGENT

This application is Continuation of application Ser. No. 08/279,852, filed on Jul. 26, 1994, now abandoned.

BACKGROUND OF THE INVENTION

1. Field of the invention

The present invention relates to a coating agent for paper and, more specifically, to a paper coating agent having excellent applicability through blade coaters or roll coaters.

2. Description of the prior art

Polyvinyl alcohol (hereinafter referred to as "PVA") has been widely used as a clear coating agent to improve the surface characteristics of paper, such as smoothness, luster and barrier properties, and as a binder for pigment coating. PVA is known to have excellent film formability and strength and is unrivaled by any other sizing agent with respect to these points.

However, as in recent years the application speed has been increasing or novel application process has appeared such as with roll coater, there have occurred several problems associated with conventional aqueous PVA solutions, which obstruct stable and uniform application. The problems are viscosity increase (dilatancy) under high shear rate conditions with blade coater, or formation of streaks or generation of mist-like scattering upon high-speed roll application.

Accordingly, an object of the present invention is to provide a PVA-based paper coating agent that has excellent applicability, while maintaining the above features of PVA, i.e. good film formability and strength.

SUMMARY OF THE INVENTION

As a result of an intensive study, the present inventors have found that a particulate PVA having an average particle diameter of 0.01 to 1 μm can, while being substantially insoluble and maintaining a slurry state when placed in cold water, dissolve during drying process after application and form film, to complete the invention.

Thus, the present invention provides a paper coating agent, which comprises a particulate PVA having an average particle diameter of 0.01 to 1 μm (preferably 0.1 to 1 μm, more preferably 0.2 to 0.9 μm).

DETAILED DESCRIPTION OF THE PREFERRED EMBODIMENTS

The particulate PVA used in the present invention may have any viscosity-average degree of polymerization (hereinafter simply referred to as "degree of polymerization") with no specific limitation, but it preferably has a degree of polymerization of at least 550, more preferably at least 700 and most preferably at least 1,000, in view of the strength properties of papers coated with the PVA. The degree of polymerization also has no specific upper limit, but it is preferably not more than 30,000, more preferably not more than 20,000.

The degree of saponification of the PVA has no specific limitation either, but it is preferably in a range of 70 to 100 mole %, more preferably in a range of 80 to 100 mole %, and most preferably in a range of 90 to 100 mole %, i.e. the higher the better.

If the average particle diameter of the particulate PVA exceeds 1 μm, the particles will not sufficiently dissolve during drying process after application, whereby the effect of the present invention is not produced sufficiently. On the other hand, if the average diameter is less than 0.01 μm, the resulting aqueous slurry will tend to have high viscosity, which is not suited for the purpose of the present invention.

The particulate PVA used in the present invention can be obtained for example by, but not limited to, ① a process which comprises conducting dispersion polymerization or emulsion polymerization of a vinyl ester, particularly vinyl acetate, to prepare a particulate polyvinyl ester, and then saponifying the polyvinyl ester in a solvent such as alcohol or paraffin or ② a process which comprises atomizing by spray drying or the like a polyvinyl ester obtained by the usual solution polymerization process, into fine particles having an average diameter of 0.01 to 1 μm and then saponifying the particles in a solvent such as alcohol or paraffin.

As the above polyvinyl ester, there are also usable polyvinyl esters having copolymerized a small amount of other unsaturated monomer copolymerizable with vinyl ester, e.g. styrene, alkyl vinyl ethers, Versatic acid vinyl ester, (meth-)acrylamide; olefins such as ethylene, propylene, α-hexene and α-octene, unsaturated acids, such as (meth)acrylic acid, crotonic acid, maleic acid, maleic anhydride, fumaric acid, itaconic acid and alkyl esters and alkali metal salts of the foregoing; sulfonic acid-containing monomers, such as 2-acrylamide-2-methylpropanesulfonic acid, and their alkali metal salts; cationic monomers, such as trimethyl-3-(1-acrylamide-1,1-dimethylpropyl)ammonium chloride, trimethyl-3-(1-acrylamidepropyl)ammonium chloride, 1-vinyl-2-methylimidazole and quaternary compounds of the foregoing and silyl group-containing monomers such as trimethoxyvinylsilane.

The particulate PVA used in the present invention can be made substantially cold water insoluble by the usual drying or heat treatment in the air or heat treatment in methanol in an autoclave, at a temperature of 100° C. or above. The term "substantially cold water insoluble" herein means having a solubility in water at 20° C. of not more than 50%.

There is known a particulate PVA having an average particle diameter of about 30 μm and obtained by pulverizing a PVA having a degree of polymerization of not more than 500. However, any PVA obtained by pulverization should have an average particle diameter exceeding 1 μm. PVA's with this large particle size cannot simultaneously satisfy the two properties of cold water insolubility and solubility during drying after application. Furthermore, this PVA, having a degree of polymerization of not more than 500, exhibits strength properties only insufficiently. As a result, this conventional particulate PVA is not suited for the purpose of the present invention.

The coating agent of the present invention may, as necessary, incorporate known additives, e.g. water resistant agents such as glyoxal and urea resins, plasticizers such as glycols and glycerine, pH adjusting agents such as phosphoric acid, antifoams, releasing agents and surfactants. In addition, there can be mixed other coating agents, e.g. PVA, modified PVA (for example, carboxylic acid-modified PVA, sulfonic acid-modified PVA, acrylamide-modified PVA, cationic group-modifed PVA and long-chain alkyl group-modified PVA), starch, modified starches, casein, carboxymethylcellulose (CMC) and synthetic resin emulsions (styrene-butadiene latex, polyacrylic acid esters emulsions, vinyl acetate-acrylic acid ester copolymers emulsions and vinyl acetate-ethylene copolymer emulsion).

The coating agent of the present invention is usable for clear coating and pigment coating and, in particular, exhibits marked effect upon application with high-speed roll coater or blade coater, but not limited to these application.

Where the coating agent of the present invention is used as an aqueous slurry, the concentration of the particulate PVA in the aqueous slurry is preferably in a range of 0.5 to 50% by weight, more preferably in a range of 1 to 40% by weight and most preferably in a range of 2 to 30% by weight. Where the coating agent is used as a pigment coating agent, the concentration of the pigment in the aqueous slurry is preferably in a range of 2 to 70% by weight, more preferably in a range of 5 to 60% by weight and most preferably in a range of 10 to 50% by weight. With the coating agent of the present invention, the amount of the particulate PVA applied on the surface of a paper is preferably in a range of 1 to 30 g-solid/$m^2$.

Where the coating agent is applied on paper as an aqueous slurry, there is no specific limitation to the application speed (surface speed of coater), but the application speed is preferably in a range of 100 to 2,000 m/min, more preferably in a range of 300 to 1,500 m/min.

Where the coating agent is applied on paper as an aqueous slurry, there is no specific limitation to the temperature of drying after the application, but the temperature is preferably in a range of 90° to 300° C., more preferably in a range of 100° to 200° C. and most preferably in a range of 100° to 180° C.

The reason why the coating agent of the present invention can exhibit excellent effects is considered to be as follows. That is, the particulate PVA behaves, upon application, as particles, thereby exhibiting low viscosity and having markedly good applicability compared with conventional solution-based PVA, and then readily dissolves during drying after application, thereby developing the good features inherent to PVA, i.e. good film formability and mechanical properties.

The paper coating agent of the present invention has excellent applicability, in particular blade coater or roll coater applicability, while maintaining good film formability and strength properties inherent to PVA.

EXAMPLES

Other features of the invention will become more apparent in the course of the following descriptions of exemplary embodiments which are given for illustration of the invention and are not intended to be limiting thereof. In the Examples and Comparative Examples that follow, "parts" and "%" mean "parts by weight" and "% by weight", respectively, unless otherwise specified. Various properties were determined by the following methods.

Cold water solubility

To 100 parts of water of 20° C., 4 parts of a particulate PVA sample is added, and, after stirring for 30 minutes, the remaining particles are removed by centrifugation. The supernatant solution was measured for PVA concentration, which then gives the cold water solubility by calculation.

$$\text{Cold water solubility (\%)} = \frac{\text{(amount of dissolved } PVA\text{)}}{\text{(amount of } PVA \text{ originally added)}} \times 100$$

High-shear viscosity

Measured with an extrusion viscometer comprising a capillary having a diameter of 0.5 mm and a length of 5.0 mm, at 20° C.

Surface strength

Measured with an IGT applicability tester, with ink M and at speed P.

Air permeability

Measured with Ohken-type permeability tester.

Average particle diameter

A particulate PVA sample is dispersed in acetone and the dispersion is tested with an electrophoresis-light scattering photometer (ELS-800, made by Otsuka Denshi K.K.) by the cumulant method.

EXAMPLE 1

A coating composition having a solid content of 50% was prepared by adding 10 parts of a particulate PVA having a degree of polymerization of 1,750, degree of saponification of 98.5 mole %, an average particle diameter of 0.2 μm and a cold water solubility at 20° C. of 1% to a slurry of 100 parts off kaolin clay dispersed in 110 parts of water.

The coating composition had a high-shear viscosity (rate of shear=$5\times10^5$ $sec^{-1}$) of 50 cps at 20° C.

The coating composition was applied through a blade coater at 20° C. on a base paper for woodfree paper in an amount of 20 g-solid/$m^2$, then dried at 105° C. for 2 minutes and calendered at a surface temperature of 80° C. under a linear pressure of 100 kg/cm. The coated paper thus obtained was conditioned at 20° C., 65% RH for 72 hours and tested for the surface strength. The results are shown in Table 1.

Comaparative Examples 1 through 4

Example 1 was repeated except that PVA's shown in Table 1 were each used instead of the particulate PVA used in Example 1. The results are also shown in Table 1.

TABLE 1

| | Degree of polymerization | Degree of saponification (mole %) | Average particle diameter (μm) | Cold water solubility (%, 20° C.) | High-shear slurry viscosity*1 (cps) | Surface strength of coated paper (cm/sec) |
|---|---|---|---|---|---|---|
| Ex. 1 | 1,750 | 98.5 | 0.2 | 1 | 50 | 150 |
| Comp. Ex. 1 | 1,750 | 98.5 | 1.5 | 1 | 50 | 50*2 |
| Comp. Ex. 2 | 500 | 98.5 | 3.5 | 1 | 50 | 15*2 |
| Comp. Ex. 3 | 1,750 | 98.5 | Aqueous soln. | 100 | high d*4 (>1000) | —*3 |
| Comp. Ex. 4 | 500 | 98.5 | Aqueous soln. | 100 | 100 | 40 |

*1: Shear rate: $5 \times 10^5$ $sec^{-1}$ at 20° C.
*2: Undissolved PVA particles found in the coated layer.
*3: Impossible to apply uniformly due to high dilatancy.
*4: "d" stands for dilatancy.

EXAMPLES 2 THROUGH 4

Aqueous slurries of particulate PVA's as shown in Table 2 were each applied with a gate roll coater (3-roll coater) onto a paper having an air permeability of 10 seconds at 20° C. and at a rate of 300 m/min in an amount of 4 g-solid/$m^2$, and dried at 105° C. for 2 minutes. The coated papers were measured for air permeability. The results are shown in Table 2.

Comparative Examples 5 through 7

Example 2 was repeated except that particulate PVA's as shown in Table 2 were used. The results are also shown in Table 2.

TABLE 2

| | PVA | | | | Air permeability of coated paper (sec) |
|---|---|---|---|---|---|
| | Degree of polymerization | Degree of saponification (mole %) | Average particle diameter (μm) | Remarks | |
| Example 2 | 1,700 | 98.5 | 0.2 | (A) | >100,000 |
| Example 3 | 1,100 | 93 | 0.5 | (B) | >100,000 |
| Example 4 | 750 | 88 | 0.8 | — | >100,000 |
| Comparative Example 5 | 500 | 98.5 | 3.0 | — | 50*1 |
| Comparative Example 6 | 500 | 98.5 | Aqueous solution | — | 5,000*2 |
| Comparative Example 7 | 1,750 | 98.5 | Aqueous solution | — | 50,000*2 |

Notes:
(A): containing 1 mole % of an anionic group
(B): containing 1 mole % of a cationic group
*1: PVA did not fully dissolve and the coating layer had many cracks.
*2: The coating layer had many streaks and was non-uniform.

EXAMPLE 5

The particulate PVA used in Example 1 was dispersed in water at 20° C., to give a 4% aqueous slurry. The aqueous slurry was flown down continuously onto the clearance between the first roll and second roll of the 3-roll coater, rotating at a surface speed of 500 m/min, and the state of scattering from between the second roll and third roll was observed. There was observed almost no scattering and the slurry was transferred uniformly onto the rolls.

Comparative Example 8

Example 5 was repeated except that a 4% aqueous solution of a PVA having a degree of polymerization of 1,750 and a degree of saponification of 98.5 mole % was used instead of the particulate PVA slurry. Then, the aqueous PVA solution scattered like mist.

EXAMPLES 6 THROUGH 9

Example 1 was repeated except that PVA's as shown in Table 3 were used. The results are shown in Table 3.

TABLE 3

| | Degree of polymerization | Degree of saponification (mole %) | Average particle diameter (μm) | Cold water solubility (% 20° C.) | High-shear slurry viscosity*1 (cps) | Surface strength of coated paper (cm/sec) |
|---|---|---|---|---|---|---|
| Ex. 6 | 1,300 | 98.6 | 0.4 | 2 | 50 | 120 |
| Ex. 7 | 4,000 | 98.7 | 0.2 | 1 | 50 | 165 |
| Ex. 8 | 7,900 | 99.2 | 0.3 | 0.5 | 50 | 180 |
| Ex. 9 | 18,000 | 99.2 | 0.3 | 0.5 | 50 | 180 |

*1: Shear rate: $5 \times 10^5$ $sec^{-1}$ at 20° C.

Obviously, numerous modifications and variations of the present invention are possible in light of the above teachings. It is therefore to be understood that within the scope of the appended claims, the invention may be practiced otherwise than as specifically described herein.

What is claimed is:

1. A paper coating agent consisting essentially of a particulate polyvinyl alcohol having an average particle diameter of 0.01 to 1 μm and a degree of saponification of 70 to 100 mole %, said polyvinyl alcohol being substantially insoluble in water at 20° C.

2. A paper coating agent consisting essentially of an aqueous slurry having a dispersoid of a particulate polyvinyl alcohol having an average particle diameter of 0.01 to 1 μm and a degree of saponification of 70 to 100 mole %, said polyvinyl alcohol being substantially insoluble in water at 20° C.

3. A paper coating agent consisting essentially of an aqueous slurry having a dispersoid of a particulate polyvinyl alcohol having an average particle diameter of 0.01 to 1 μm and a degree of saponification of 70 to 100 mole % and a pigment, said polyvinyl alcohol being substantially insoluble in water at 20° C.

* * * * *